US007029005B2

(12) United States Patent
Brock et al.

(10) Patent No.: US 7,029,005 B2
(45) Date of Patent: Apr. 18, 2006

(54) MEDIA POSITIONING AT A PICKING LOCATION

(75) Inventors: Kelly A. Brock, Battle Ground, WA (US); Jiangxiao Mo, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 238 days.

(21) Appl. No.: 10/411,920

(22) Filed: Apr. 11, 2003

(65) Prior Publication Data

US 2004/0201163 A1 Oct. 14, 2004

(51) Int. Cl.
*B65H 5/32* (2006.01)

(52) U.S. Cl. ..... 271/121; 271/124; 271/167

(58) Field of Classification Search ..... 271/121, 271/124, 167

See application file for complete search history.

(56) References Cited

U.S. PATENT DOCUMENTS

| | | | | |
|---|---|---|---|---|
| 6,065,886 | A * | 5/2000 | Embry et al. | 400/629 |
| 6,135,444 | A | 10/2000 | Padget | |
| 6,152,440 | A | 11/2000 | Yip et al. | |
| 6,257,569 | B1 | 7/2001 | Rhodes et al. | |
| 6,457,707 | B1 | 10/2002 | Hendrix et al. | |
| 6,485,014 | B1 * | 11/2002 | Lin | 271/121 |
| 6,540,221 | B1 * | 4/2003 | Nakashima et al. | 271/121 |
| 2002/0060396 | A1 * | 5/2002 | Tanaka | 271/121 |

* cited by examiner

*Primary Examiner*—Donald P. Walsh
*Assistant Examiner*—Kaitlin Joerger

(57) ABSTRACT

A method and apparatus for positioning media that in an embodiment includes a plate attached to a wall along a pivot axis. A spring is attached to the wall and to the plate, and the spring expands to push the plate and the media to a picking location.

30 Claims, 3 Drawing Sheets

MEDIA POSITIONING AT A PICKING LOCATION

BACKGROUND INFORMATION

Computer printers normally operate by drawing single sheets of blank media (such as paper or transparent film) from a horizontal stack of sheets. Each sheet is individually drawn or "picked" from the stack and fed into the media path of the printer. If no sheets are drawn during an attempted pick, a "no pick" failure has occurred; if two (or more) sheets are picked in an overlapping manner, a "two (or multiple) pick" failure has occurred. If the sheets are not properly aligned and properly located at the designated picking location, the aforementioned failures can occur plus the sheets may jam in the media path or the print on the sheets may be skewed. In the event of any of these failures, printing may be suspended, media may be wasted, and a user may be inconvenienced.

Some printers have attempted to solve the problem of media not being aligned at the proper picking location by using a removable media tray with teeth on an inside wall of the tray, which provide a media stop. But, this technique requires extra parts, which increases the cost of the printer. Also, the user is inconvenienced by having to remove the media tray in order to replenish the media.

Although the above discussion has described the problems associated with feeding media through a printer, the problems apply equally to other types of devices that feed media, such as copiers, fax machines, scanners, plotters, currency counters, and ATMs (Automated Teller Machines).

DETAILED DESCRIPTION OF THE INVENTION

In the following detailed description of the embodiments, reference is made to the accompanying drawings that form a part hereof, and in which are shown by way of illustrating specific embodiments in which the invention may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of the present invention. Each instance of the word "embodiment" as used herein does not necessarily refer to the same embodiment. The following detailed description, therefore, is not to be taken in a limiting sense, and the scope of various embodiments of the invention is defined only by the appended claims, along with the full range of equivalents to which such claims are entitled.

Figure 1:
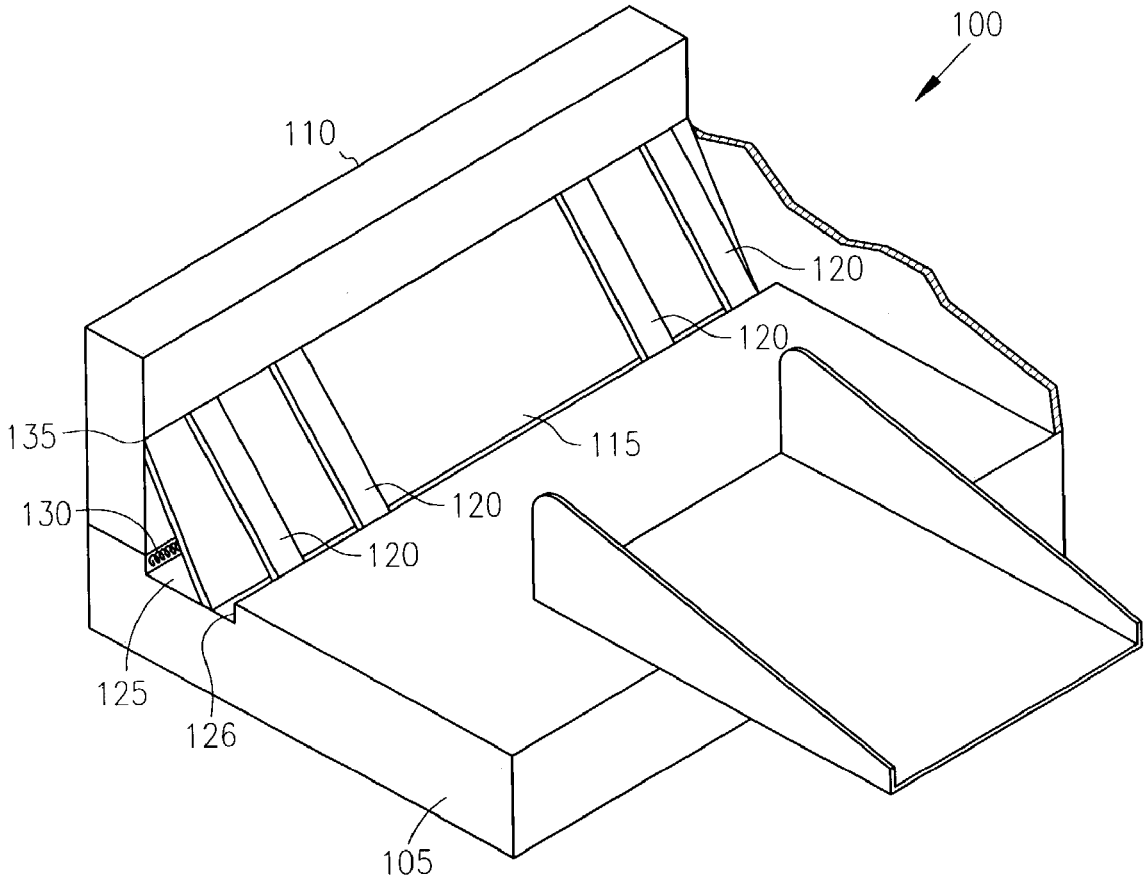
FIG. 1 is a perspective view of a media feeding mechanism with the housing thereof partially removed, according to an embodiment of the invention.

FIG. 1 is a perspective view of a media feeding mechanism 100 with the housing thereof partially removed, according to an embodiment of the invention. The media feeding mechanism 100 includes a base 105 attached to a wall 110. The base 105 includes a depression 125 or recess that has an edge 126. A rotation plate 115 is attached at an end to the wall 110 at a pivot point or along a pivot axis 135. In an embodiment, the rotation plate 115 may be attached along the pivot axis 135 via a pin or pins, but in other embodiments any mechanism that allows pivoting of the rotation plate 115 with respect to the wall 110 may be used.

A spring 130 is attached to the wall 110 and the rotation plate 115 at an opposite end from the pivot axis 135. When a stack of media (not shown) pushes the rotation plate 115 toward the wall 110, the spring 130 compresses, and the rotation plate 115 becomes disposed at approximately a vertical position against the wall 110. In an embodiment, a user exerts pressure to push the stack of media (not shown) against the rotation plate 115. But, in other embodiments, any appropriate type of mechanical or electromechanical member may be used to exert pressure to push the stack of media against the rotation plate 115.

When the media is released, the spring 130 expands to push the rotation plate 115 away from the wall 110. Attached to the rotation plate 115 is at least one pivot stop 120. The pivot stop(s) 120 contact the edge 126 of the depression 125 when the spring 130 pushes the rotation plate 115 away from the wall 110 to the edge 126. The edge 126 thus stops the rotation plate 115 from pivoting away from the wall 110 by contacting the pivot stops 120.

As the spring 130 pushes the rotation plate 115 away from the wall 110 and toward the edge 126, the rotation plate 115 consequently pushes the media stack (not shown) to the edge 126. The edge 126 serves as a picking location for the stack of media (not shown), as further described below with reference to FIG. 2.

In an embodiment, the pivot stops 120 are extension blocks that are attached to the rotation plate 115 and extend below the lower edge of the rotation plate 115. But, in other embodiments, the pivot stops 120 may be formed as part of the rotation plate 115. In still other embodiments, the pivot stops 120 may be the lower edge of the rotation plate 115. Although the rotation plate 115 is illustrated in FIG. 1 as including four pivot stops 120, in other embodiments any number of pivot stops may be present.

In various embodiments, the spring 130 may be a spiral spring, a helical spring, a coil spring, an extension spring, a torsion spring, a drum spring, a pagoda spring, a recantation spring, a spring plunger, spring steel, a bias element, or any other mechanism that compresses and expands. Although only one spring 130 is shown in FIG. 1, in other embodiments, any number of springs may be present. The spring 130 has a force that allows the rotation plate 115 to rotate back against the wall 110 during loading of the media stack. The force of the spring 130 is also sufficient to push the rotation plate 115 and the media stack back to the proper pick position at the edge 126 after the media stack is released.

Figure 2:
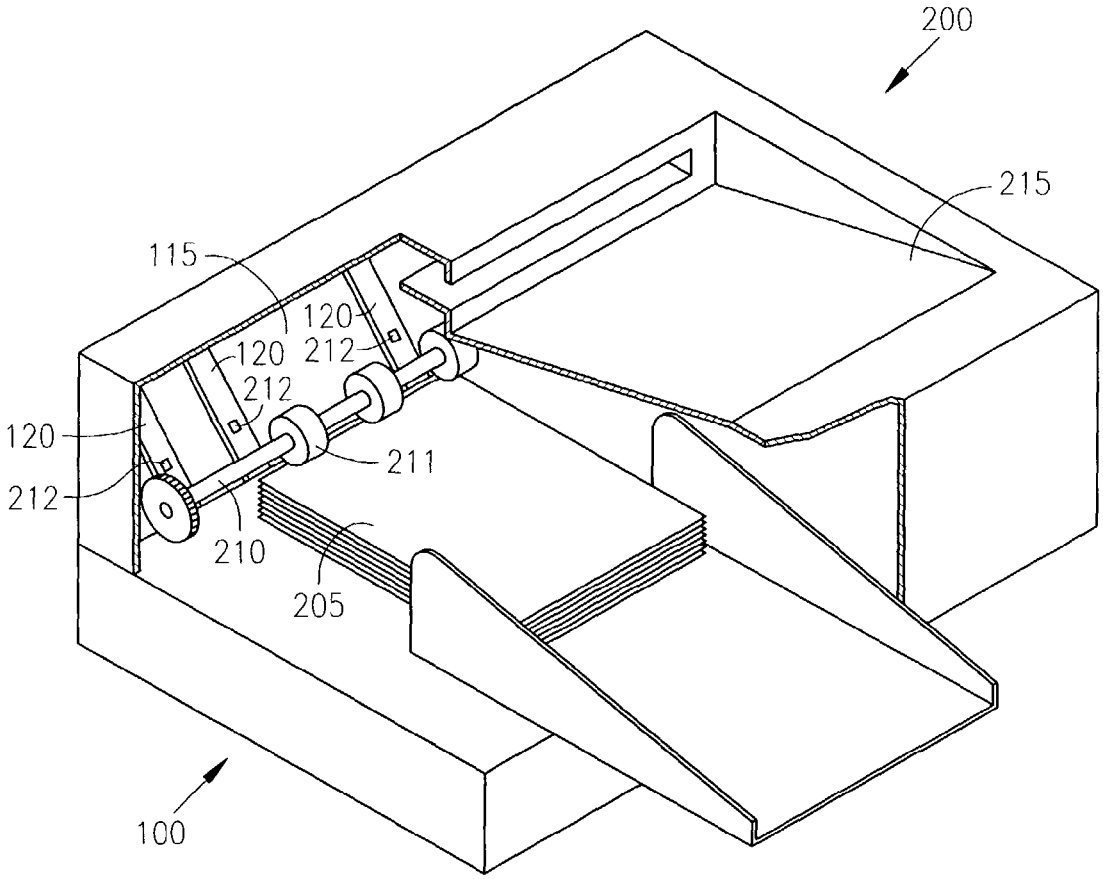
FIG. 2 is a perspective view of a device incorporating the media feeding mechanism of FIG. 1, according to an embodiment of the invention.

FIG. 2 is a perspective view of a device 200 incorporating the media feeding mechanism 100 of FIG. 1, according to an embodiment of the invention. In an embodiment, the device 200 may be a printer, such as a laser printer, an inkjet printer, or other appropriate type of printer. But, in other embodiments, the device 200 may be a copier, a fax machine, a scanner, a plotter, a currency counter, an ATM (Automated Teller Machine), any device capable of feeding media, or any combination of the aforementioned devices.

The stack of media 205 is fed into the device 200 where it is aligned at the picking location 126 (FIG. 1) using the action of the rotation plate 115 and the spring 130 (FIG. 1), as previously described above with reference to FIG. 1. The stack of media 205 may be any suitable sheet media.

Examples of embodiments of sheet media are paper, envelopes, labels, currency, card-stock, plastic, transparencies, foils, Mylar®, vellum, or any other appropriate sheet media of any composition, weight, and size.

The device 200 includes a picker 210 disposed generally near the picking location 126 (FIG. 1). The picker 210 picks individual sheets from the media stack 205 at the picking location 126 (FIG. 1). Although the picker 210 is illustrated in FIG. 2 as tires 211 on a roller or shaft, in other embodiments, the picker may be a single tire, a cam, or any other appropriate mechanism for picking a sheet from the stack of the media 205. A typical picker includes a drive or pick roller oriented just above a leading edge of the media stack 205, for rotation about an axis parallel to the stack edge.

The roller may include one or more tires or cams or drums 211 spaced along its length. When the leading edge of the stack 205 is lifted, the top sheet contacts the tire, cam, or drum surface, and rotation of the roller slides the top sheet off the remaining stack. To help prevent multiple picks, a separator pad 212 opposite one or more tires, cams, or drums 211 rubs on the opposite surface of the picked sheet or sheets. In an embodiment, the separator pad 212 is embedded in the pivot stop 120, but in other embodiments, the separator pad 212 may be located at any appropriate location. With respect to a media surface, the friction coefficient of the separator pad 212 is less than that of the pick tire, cam, or drum 211, and greater than that of the media, so that a properly picked single sheet proceeds along the media path, while the improper lower sheets of a multiple pick are held by the pad 212, as the upper sheet proceeds alone.

When the picked sheet contacts the pivot stops 120, the sheet curls up before passing past a mechanism (not shown) that prints, reads, draws, scans, copies, counts, and/or otherwise processes the sheet, depending on the purpose and type of the device 200. The processed sheet is then deposited in a return tray 215. Although the return tray 215 is illustrated as being located on top of the device 200, in another embodiment, the return tray 215 may be located behind the device 200 or in any other appropriate location.

The picking mechanism described herein is but one embodiment, and other picking mechanisms may be used in other embodiments.

Figure 3:
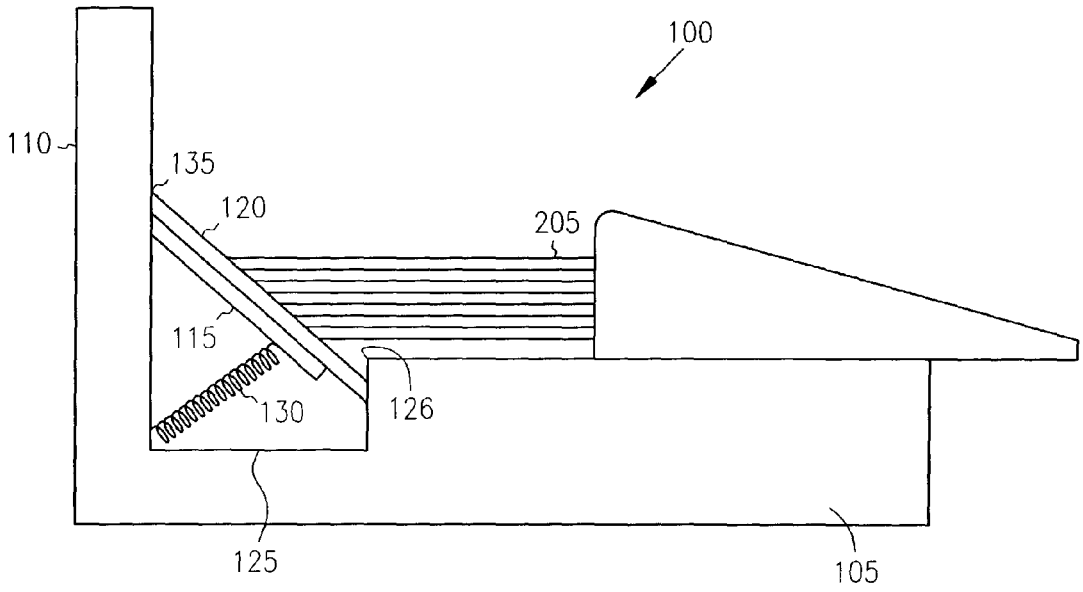
FIG. 3 is a side view of the media feeding mechanism of FIG. 1, according to an embodiment of the invention.

FIG. 3 is a side view of the media feeding mechanism of FIG. 1, according to an embodiment of the invention. The media feeding mechanism 100 includes a base 105 attached to a wall 110. The base 105 includes a depression 125 or recess that has an edge 126. A rotation plate 115 is attached at an end to the wall 110 at a pivot point or along a pivot axis 135.

A spring 130 is attached to the wall 110 and the rotation plate 115 at an opposite end from the pivot axis 135. When the stack of media 205 pushes the rotation plate 115 toward the wall 110, the spring 130 compresses, and the rotation plate 115 becomes disposed at approximately a vertical position against the wall 110. By pushing the rotation plate 115 toward the wall 110, the stack of media 205 does not feed through the paper path, but instead the user can feel that the stack of media 205 has stopped when the rotation plate 115 contacts the wall.

When the media is released, the spring 130 expands to push the rotation plate 115 away from the wall 110. Attached to the rotation plate is at least one pivot stop 120. The pivot stop(s) 120 contact the edge 126 of the depression 125 when the spring 130 pushes the rotation plate 115 away from the wall 110 to the edge 126. The edge 126 thus stops the rotation plate 115 from pivoting away from the wall 110 by contacting the pivot stops 120. When the pivot stops 120 contact the edge 126, the rotation plate 115 is at an acute angle with respect to the wall 110.

As the spring 130 pushes the rotation plate 115 away from the wall 110 and toward the edge 126, the rotation plate 115 consequently pushes the media stack 205 to the edge 126. By the action of rotating away from the wall 110 and by the acute angle of the rotation plate 115 with respect to the wall 110 when the pivot stops 120 contact the edge 126, the rotation plate 115 aligns the stack of media 205 at the picking location 126. This alignment causes the top sheets in the stack of media 205 to be closer to the wall 110 than the bottom sheets in the stack of media 205. This alignment of the stack of media 205 aids in the picking of sheets from the stack of media 205, as previously described above with reference to FIG. 2.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus comprising:

a plate attached to a wall along a pivot axis to pivot between a first position in which the plate is configured to extend at a first angle with respect to a surface of media to be picked and a second position in which the plate is configured to extend at a second greater angle with respect to the surface of the media; and a spring attached to the wall and to the plate, wherein the spring is configured to resiliently bias the plate towards the second position.

2. The apparatus of claim 1, wherein the spring is to compress when the plate is pushed toward the wall by the media.

3. The apparatus of claim 1, further comprising:

a base attached to the wall, wherein the base further comprises a depression having an edge, and wherein the edge contacts the plate when the plate is in the second position.

4. The apparatus of claim 2, wherein the plate is to pivot about the pivot axis when the plate is pushed toward the wall by the media.

5. The apparatus of claim 1, wherein the media comprises a stack of plurality of sheets.

6. The apparatus of claim 5, wherein the sheets comprise paper.

7. The apparatus of claim 5, wherein the sheets comprise currency.

8. The apparatus of claim 5, wherein the sheets comprise foils.

9. The apparatus of claim 5, wherein the sheets comprise cards.

10. The apparatus of claim 2, wherein the spring is configured to expand to push the plate to the second position after the media is released.

11. The apparatus of claim 1, wherein the plate comprises a pivot stop configured to limit pivoting of the plate beyond the second position when the spring is expanded.

12. The apparatus of claim 11, wherein the pivot stop comprises at least one block that extends from the plate.

13. An apparatus comprising:

means for abutting a media stack at a first angle with respect to a surface of the media stack to be picked during loading of the stack; and means for abutting the media stack at a second greater angle with respect to the surface of the media stack to be picked during picking.

14. A method comprising:

pivoting a rotation plate away from a picking location to decrease an angle between the plate and a surface of media to be picked; and pivoting the rotation plate toward the picking location to push a media stack to the picking location.

15. The method of claim 14, wherein the pivoting the rotation plate away from the picking location further comprises:

compressing a spring against a wall, wherein the spring is connected to the wall and the rotation plate.

16. The method of claim 14, wherein the pivoting the rotation plate toward the picking location further comprises:

expanding a spring to push the rotation plate toward the picking location.

17. The method of claim 14, wherein the pivoting the rotation plate away from the picking location further comprises:

pivoting the rotation plate about a pivot axis on a wall.

18. The method of claim 14, wherein the pivoting the rotation plate toward the picking location further comprises:

pivoting the rotation plate about a pivot axis on a wall.

19. The method of claim 14, wherein the pivoting the rotation plate away from the picking location further comprises:

pushing the rotation plate with the media stack.

20. The method of claim 14, wherein the pivoting the rotation plate toward the picking location further comprises:

pivoting the rotation plate until the rotation plate contacts the picking location.

21. The method of claim 15, wherein the pivoting the rotation plate toward the picking location further comprises:

pivoting the rotation plate until a pivot stop on the rotation plate contacts an edge of a depression in a base, wherein the base is attached to the wall.

22. A device comprising:

a wall;

a plate attached to the wall along a pivot axis so as to pivot between a first position in which the plate is configured to extend at a first angle with respect to a surface of media to be picked and a second position in which the plate is configured to extend at a second greater angle with respect to the surface of the media;

a spring attached to the wall and the plate, wherein the plate is to compress the spring in response to pivoting of the plate from the second position towards the first position, and wherein the spring is to expand to push the plate towards the second position; and a picker to pick a sheet from the stack when the plate is at the second position.

23. The device of claim 22, wherein the plate comprises a pivot stop that is to stop the plate from pivoting about the pivot axis when the plate is at the second position.

24. The device of claim 22, wherein the pivot stop further comprises a separator pad having a friction coefficient that is less than a friction coefficient of the picker and the greater than a friction coefficient of the media.

25. The device of claim 22, wherein the plate is attached at the pivot axis via a pin.

26. The device of claim 22, wherein the plate is to align the stack of media at the picking location with a top sheet of the stack of media being closer to the wall than a bottom sheet of the stack of media.

27. The apparatus of claim 1, wherein the plate is substantially vertical in the first position.

28. The apparatus of claim 1 further comprising a media support surface configured to support an underside of the media, wherein the support surface is substantially horizontal.

29. An apparatus comprising:

a surface configured to abut an edge of a sheet, wherein the surface is further configured to pivot between a first position in which the surface extends at a first angle with respect to a face of the sheet to be engaged by a picker and a second position in which the surface is configured to extend at a second greater angle with respect to the face of the sheet to be picked, wherein the surface is resiliently biased towards the second position; and a picker configured to engage the face of the sheet to pick the sheet.

30. An apparatus comprising:

a plate attached to a wall along a pivot axis; and a spring attached to the well and to the plate, wherein the spring is to expand to position the plate and media at a picking location, wherein the plate comprises a pivot stop configured to limit pivoting of the plate beyond the second position when the spring is expanded.

* * * * *

UNITED STATES PATENT AND TRADEMARK OFFICE

CERTIFICATE OF CORRECTION

PATENT NO. : 7,029,005 B2
APPLICATION NO. : 10/411920
DATED : April 18, 2006
INVENTOR(S) : Kelly A. Brock et al.

It is certified that error appears in the above-identified patent and that said Letters Patent is hereby corrected as shown below:

In column 4, line 51, in Claim 5, after "of" insert -- a --.

In column 6, line 12, in Claim 24, delete "claim 22," and insert -- claim 23, --, therefor.

In column 6, line 14, in Claim 24, after "and" delete "the".

In column 6, line 44, in Claim 30, delete "well" and insert -- wall --, therefor.

Signed and Sealed this

Eleventh Day of August, 2009

David J. Kappos

David J. Kappos
*Director of the United States Patent and Trademark Office*